United States Patent [19]

Nutter

[11] 4,141,418

[45] Feb. 27, 1979

[54] SAFETY VALVE HYDRAULICALLY OPERATED BY TELESCOPIC DRILL STEM MOVEMENT

[75] Inventor: Benjamin P. Nutter, Bellville, Tex.

[73] Assignee: Schlumberger Technology Corporation, New York, N.Y.

[21] Appl. No.: 830,714

[22] Filed: Sep. 6, 1977

[51] Int. Cl.[2] ..... E21B 43/12

[52] U.S. Cl. ..... 166/324; 166/332

[58] Field of Search ..... 166/321, 319, 334, 333, 166/332, 324; 251/63.4; 175/242, 318

[56] References Cited

U.S. PATENT DOCUMENTS

| | | | |
|---|---|---|---|
| 3,367,422 | 2/1968 | Sims | 166/187 |
| 3,845,818 | 11/1974 | Deaton | 166/322 |
| 3,901,321 | 8/1975 | Mott | 166/314 |

*Primary Examiner*—Ernest R. Purser

*Attorney, Agent, or Firm*—David L. Moseley; William R. Sherman

[57] ABSTRACT

In accordance with an illustrative embodiment of the present invention as disclosed herein, a combination slip joint-safety valve tool includes telescoping mandrel and housing members, a full-opening valve on the housing member operable when closed to prevent upward flow of fluid through said members, and hydraulically operable valve actuator means responsive to contraction of said telescoping members for closing said valve and to extension of said members for opening said valve.

17 Claims, 10 Drawing Figures

FIG. 2F
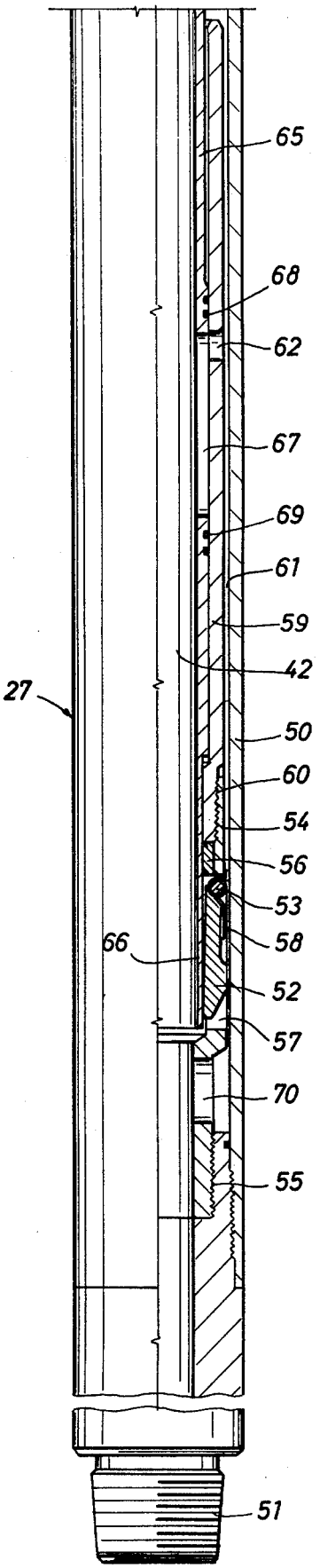
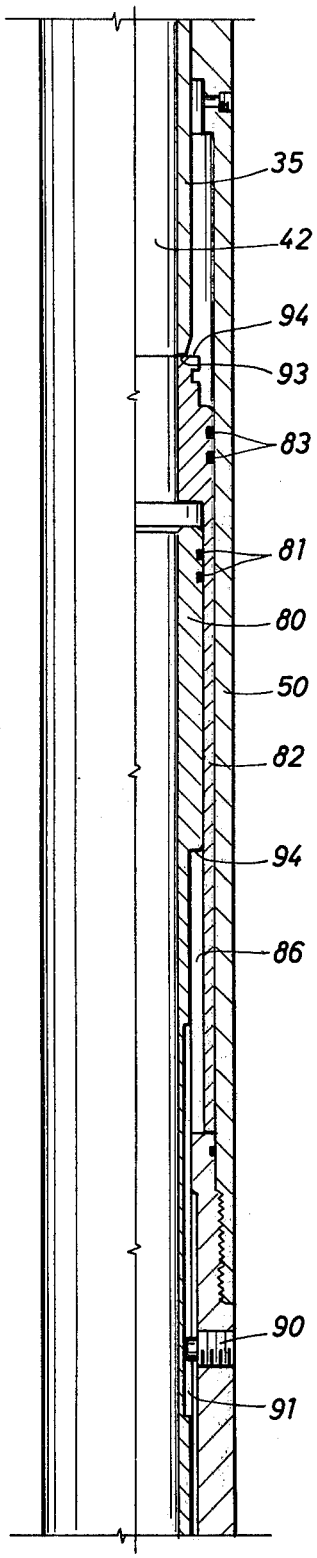
FIG. 3A

SAFETY VALVE HYDRAULICALLY OPERATED BY TELESCOPIC DRILL STEM MOVEMENT

This invention relates to a downhole safety valve system useful in conducting a drill stem test of an offshore well from a floating drilling vessel.

In my U.S. Pat. No. 3,653,439, assigned to the assignee of this invention, a combination slip joint-safety valve apparatus is disclosed and claimed which functions to automatically shut off the pipe string against upward flow of fluids from an isolated formation interval should the pipe string on which the drill stem testing tools have been run into the well break in two thereabove. Although the system disclosed in such patent possesses many advantages, there is a need in cases where wireline tools such as perforating guns and the like are to be run into the well in association with the drill stem test to provide "full-opening" capability. The term "full-opening" is used herein in the usual sense that the tool is provided with a straight through vertical opening of no lesser diameter than the bore of the pipe string in which the tool is connected.

The device shown in the U.S. Pat. No. 3,653,439 could be made full-opening by removing a barrier therein utilizing a drop-bar technique as disclosed in the specification. However, after the barrier is removed, the safety valve feature is no longer operable and the tool cannot then be utilized to close the pipe in case of an emergency.

An object of the present invention is to provide a new and improved full-opening safety valve that is adapted for incorporation in the drill stem below the sea floor and which functions automatically to close off the bore of the drill stem should the same accidentally be broken off.

Another object of the present invention is to provide a new and improved safety valve apparatus of the type described that normally provides a full-opening passage therethrough, but which will automatically close if the drill stem is not in tension, which would occur, for example, if the drill stem should break in two.

Still another object of the present invention is to provide a new and improved full-opening safety valve of the type described, in combination with a balanced slip joint to enable changes in pipe length to occur due to changes in pressure and/or temperature in the well, without placing the pipe in compression so that the safety valve remains open.

A further object of the present invention is to provide a new and improved valve apparatus adapted for downhole usage which includes a unique motion reversing system whereby longitudinal movement in one direction of one valve actuator part results in longitudinal movement in the opposite direction of another valve actuator part to cause opening or closing of a valve element which is, in a preferred embodiment, a full-opening design.

These and other objects are attained in accordance with the concepts of the present invention by apparatus comprising an upper inner member telescopically disposed within a lower outer member and movable from an extended position to a contracted position when the pipe string is not in tension. The members define a flow passage extending vertically therethrough, and full-opening valve means in the form, for example, of a flapper valve is employed to open and close the flow passage. The valve means is coupled to a longitudinally movable first valve actuator means that moves upwardly in the outer member to enable closure of the valve means against upward flow in the pipe string, and downwardly to cause opening thereof. A chamber contains a hydraulic fluid that is cooperable with the first actuator means for moving it upwardly in response to displacement of hydraulic fluid within the chamber. A second force responsive valve actuator means is movable downwardly in the outer member in response to relative movement of the members to contracted position and functions to displace fluid in the chamber and cause upward movement of the first valve actuator means.

Thus, the valve means when open provides for a full-flow opening as well as unrestricted access through the pipe string for wireline tools and the like, and when closed prohibits upward flow of formation fluids from the well. The arrangement of the hydraulic fluid chamber and the coaction between the fluid and the actuators provides a motion reversing system enabling the valve means to be closed due to upward movement of a valve actuator as the inner and outer members move to fully contacted or closed position.

The present invention has other objects and advantages which will become more clearly apparent in connection with the following detailed description of a preferred embodiment, taken in conjunction with the appended drawings in which:

FIGS. 2A–2F are longitudinal sectional views, with portions in side elevation, of a combination slip joint and full-opening safety valve apparatus in accordance with the present invention, successive figures forming lower continuations of one another; and FIGS. 3A–3C are views similar to FIG. 2 but with the valve element in closed condition.

Figure 1:
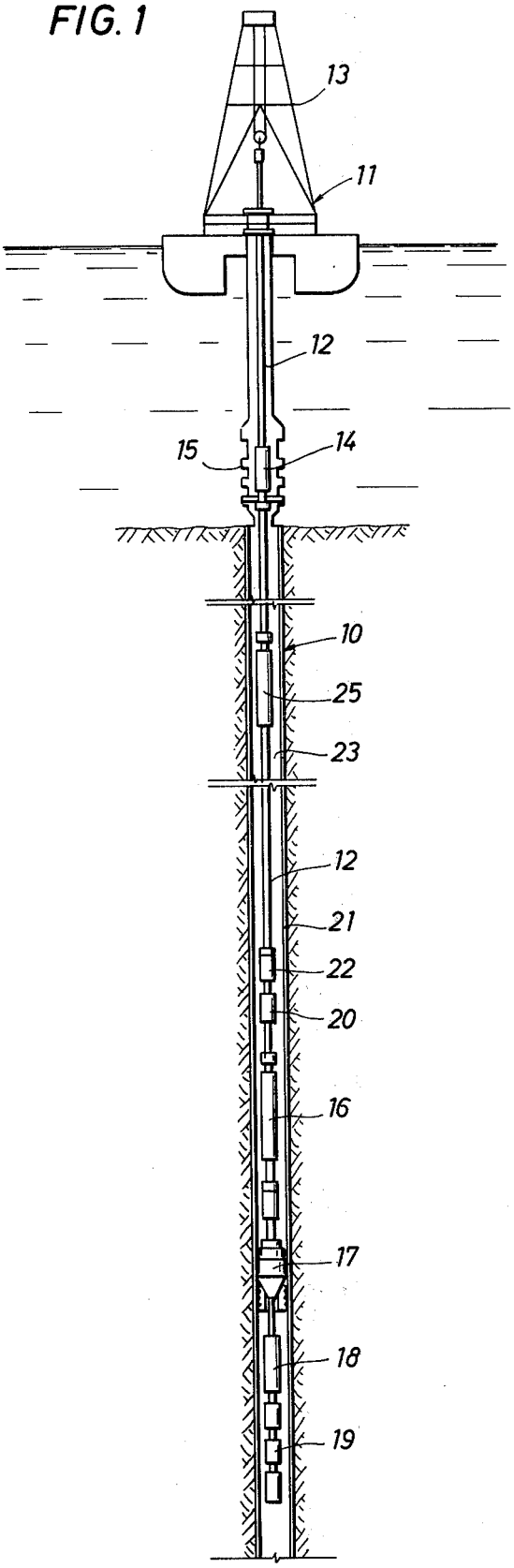
FIG. 1 is a schematic view of an offshore drill stem testing operation being conducted from a floating vessel.

Referring initially to FIG. 1, an environment in which the present invention has particular utility is in testing an offshore well 10 that is being drilled from a floating drilling vessel 11. A pipe string 12 is supported in the derrick 13 and extends from the vessel 11 to a subsea control valve 14 landed within a subsea BOP stack 15, the valve assembly 14 being of the type shown in Young, U.S. Pat. No. 3,967,647, assigned to the assignee of this invention. The pipe string 12 suspends a series of testing tools including a tester valve assembly 16 connected to a well packer 17 and a perforated anchor pipe 18 having pressure recorders 19 mounted at its lower end. A typical reversing valve 20 is located above the tester valve assembly 16, as well as a lower slip joint assembly 22. The packer 17 is of known construction shown, for example, in McGill, U.S. Pat. No. 3,399,729 and functions to pack-off and isolate the well zone to be tested, and incorporates a bypass passage and valve to enable pressures to be equalized at the end of the test. The tester valve assembly 16 includes a full-opening valve and is designed to be actuated in response to changes in the pressure of fluids in the well annulus 23 defined between the pipe 12 and the well casing 21.

A combination slip joint and safety valve assembly 25 constructed in accordance with the present invention is interconnected in the pipe string 12 below the well head 15. The assembly 25, as will appear more fully with reference to the following detailed description, enables changes in length of the pipe 12 due to temperature and pressure variations, and provides a structure for automatically closing off flow through the pipe string in the event of breakage thereof at a location below the control valve 14.

The assembly 25, as shown in FIGS. 2A–2F, includes a slip joint section 26 and a safety valve section 27. The slip joint section 26 comprises a mandrel 28 that is telescopically disposed within a tubular housing 29 and which has a collar 30 at its upper end adapted for connection to the drill pipe 12. A spline sub 31 of the mandrel 28 has external splines 32 that are slidably meshed with internal splines 33 on the upper sub 34 of the housing 29 to prevent relative rotation, and suitable stop shoulders are provided on the mandrel and housing to limit the extent of telescoping motion. Suitable apertures may be provided if desired in the wall of the housing for fluid transfer during telescoping movement. A seal sub 35 of the mandrel 28 extends downwardly through an inwardly thickened portion 36 (FIG. 2B) of the housing 29 which carries a seal assembly 37 engaging the outer periphery of the seal sub. An enlarged diameter piston section 38 (FIG. 2C) on the sub 35 carries a seal assembly 39 that is sealingly slidable on the inner wall surface 40 of the housing 29. One or more radial ports 4 extend through the wall of the sub 35 above the piston 38 to subject the upper face thereof to the pressure of fluids in the bore 42 of the mandrel, and other ports 42' extend through the wall of the housing 29 at the lower end of the annular chamber 43 formed between the mandrel and the housing to subject the lower face of the piston 38 to the pressure of fluids in the well annulus externally of the housing. The effective pressure area of the piston 38, which may be considered to be transverse cross-sectional area of the annular chamber 43, is made substantially equal to the transverse cross-sectional area defined by the outer peripheral surface of the mandrel 28 adjacent the seal assembly 37 to provide a pressure-balanced design for purposes to be disclosed more fully herebelow. A lower seal assembly 44 carried on an inwardly thickened housing section 45 seals against the outer periphery of the mandrel sub 35 at the lower end of the chamber 43.

Figure 2A:
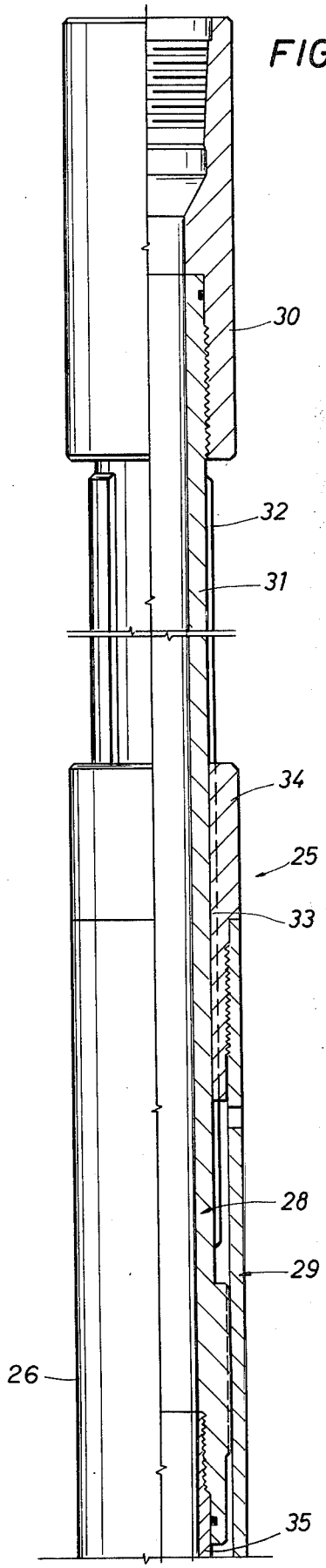
Figure 2B:
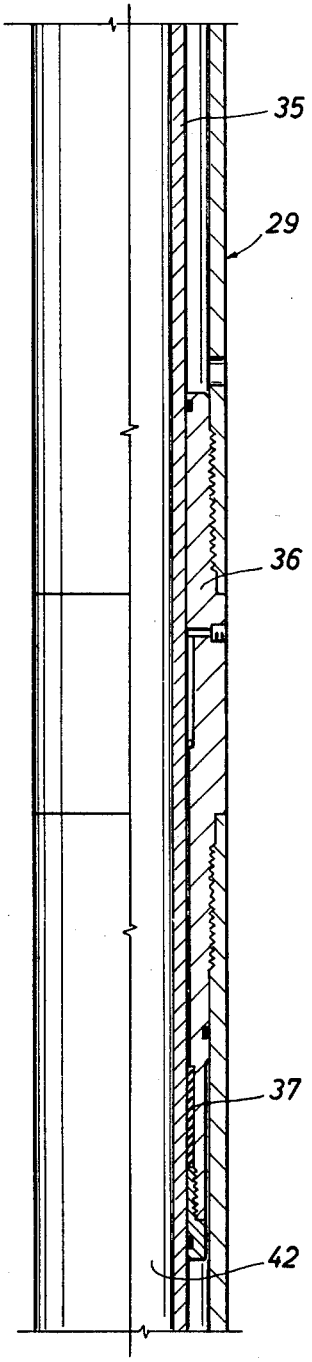
Figure 2C:
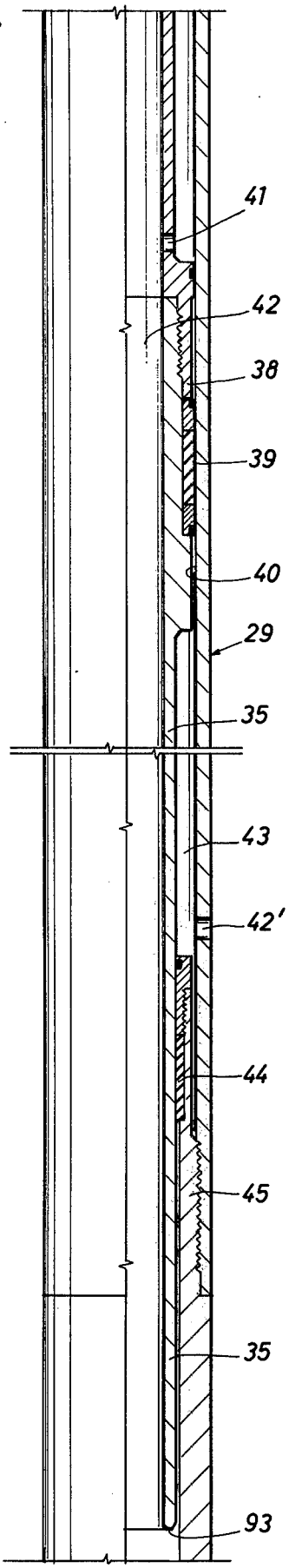
Figure 2D:
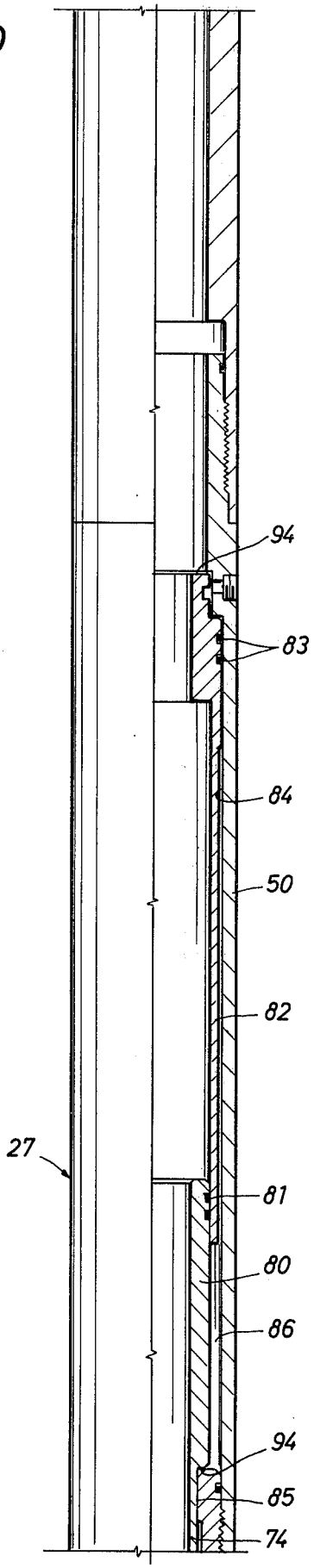
Figure 2E:
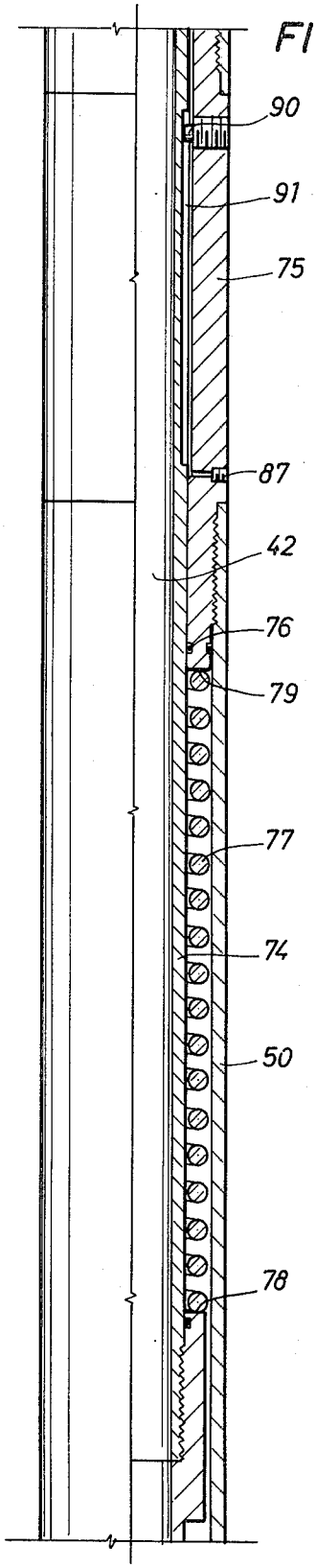

The valve section 27, as shown in FIGS. 2D–F, comprises a lower tubular housing member 50 having a threaded pin 51 at its lower end (FIG. 2F) adapted for connection to the pipe string 12. A full-opening valve element in the form of a flapper or disc 52 is hinged by a pivot pin 53 to a mounting sleeve 54 whose lower end is rigidly attached to the pin 51 by threads 55. The valve element 52 is movable between an open position to the side of the bore 42 through the sleeve 54 as shown in FIG. 2F, and a closed position transverse to the bore where the upper surface thereof sealingly engages a seat ring 56. A window 57 receives the valve element 52 in its open position, and a hinge spring 58 of suitable construction continuously urges pivotal rotation of the valve element to its closed position against the seat ring 56. A bypass and equalizing sleeve 59 is attached by threads 60 to the upper end of the valve mounting sleeve 54 and extends upwardly within the housing member 50 in laterally spaced relation to the inner wall surface thereof to provide an annular flow passage 61. A plurality of circumferentially spaced and radially directed ports 62 are formed through the wall of the sleeve 59 in the upper end portion thereof.

A valve actuator mandrel 65 is slidable vertically within the housing 50 between a lower position shown in FIG. 2F where a stinger 66 attached to the lower end thereof is extended through the seat ring 56 to hold the valve element 52 in the open position, and an upper position where the stinger is withdrawn through the seat ring to enable pivotal rotation of the valve element 52 to the closed position against the seat ring 56. A plurality of elongated bypass ports 67 are formed through the wall of the actuator mandrel 65 and are arranged to be isolated from the sleeve ports 62 in the upper position of the mandrel by vertically spaced seals 68, 69. As the actuator mandrel 65 is moved downwardly from its upper position as will be described subsequently, the lower end portion of the ports 67 will be brought into registry with the sleeve ports 62 prior to opening of the valve element 52 by the stinger 66 to permit fluids to pass via the annular passage 61, outside the mounting sleeve 54 adjacent the valve element 52, and then into the bore of the sleeve below the valve through port 70 so that the valve element will be opened under conditions of substantially equalized pressures. Moreover, due to the elongated configuration of the ports 67, they will remain in registry with the ports 62 until after the stinger 66 has disengaged from the valve element 52 to also enable closure thereof under condition of substantially equalized pressures.

As shown in FIG. 2E, an upper section 74 of the actuator mandrel 65 extends upwardly through a reduced diameter portion 75 of the tubular housing 50 and is sealed with respect thereto by an O-ring seal 76. A coil spring 77 is mounted around the mandrel 74 in compression between oppositely facing shoulder surfaces 78 and 79 on the mandrel 74 and the housing 50, respectively. The uppermost end portion 80 of the mandrel section 74 is enlarged in diameter as shown in FIG. 2D and is sealed by O-rings 81 with respect to a sleeve piston 82 that also is movable vertically within the housing member 50. The sleeve piston 82 carries seals 83 on its outer periphery which are sealingly slidable against an inner wall surface 84 of the housing.

The lateral spacing between the outer wall surface 85 of the actuator mandrel 74 below the enlarged diameter section 80 thereof, and the inner wall surface 84 of the housing 50 above the reduced diameter section 75 thereof, provides a generally annular cylinder space 86 which is filled with a hydraulic fluid through a suitable fill plug 87. The lower end portion of the sleeve piston 82 extends into such cylinder space and thereby displaces a volume of the oil dependent upon the vertical position of the sleeve piston relative to the housing 50. In the uppermost position on the piston 82 shown in FIG. 2D, the sleeve 82 displaces a minimum amount of oil which results in downward shifting of the actuator mandrel 74 by the spring 77 to its lowermost position to cause opening of the valve element 52 by the stinger 66. Conversely, in the lowermost position of the sleeve piston 82 where it displaces a maximum amount of the oil in the chamber 86, the actuator mandrel 74 is shifted upwardly against the bias of the spring 77 to its uppermost position where the stinger 66 is withdrawn through the seat 56 to enable the valve element 52 to swing to the closed position.

A guide pin 90 (FIG. 2E) mounted in the wall of the reduced diameter housing section 75 engages an elongated vertical slot 91 in the outer periphery of the actuator mandrel 74 to provide for radial alignment of the bypass ports 67, 62 in the open position thereof.

In operation, the slip joint safety valve apparatus of the present invention is assembled as shown in the drawings and made up in the pipe string with the mandrel 31 extended and with the sleeve piston 82 in the upper position as shown in FIG. 2D, the chamber 86 being filled with hydraulic fluid. The power spring 77 holds the actuator mandrel 74 in the lower position where the valve element 52 is open to provide an unobstructed vertical passage through the tool. The testing tools shown in FIG. 1 are run into the well and the packer 17 is set in a typical manner above the formation to be tested in order to isolate it. The lower slip joint 22 is telescoped so as to be in compression, and the subsea control valve 14 is landed in the BOP stack 15 in such a manner and spacing that the slip joint section 25 either is in tension and thus extended, or the mandrel 28 can occupy a mid-position with respect to the housing 29. During a drill stem test, changes in fluid pressure that occur within the pipe string 12 do not affect the position of the slip joint because of the previously mentioned equality of the transverse cross-sectional areas of the mandrel 28 at the seal assembly 37, and the piston 38. Thus, forces acting upwardly on the mandrel 28 due to greater pressures within the assembly than in the annulus 23 are balanced by equal forces acting downwardly on the piston 38. It will be apparent, therefore, that the slip joint section 25 can telescope freely to accomodate changes in pipe length due to temperature or pressure changes in the well, and is not influenced by applied fluid pressures. Further, telescoping action on the slip joint itself does not affect the existing pressures of fluids in the pipe string or in the well annulus.

The full-opening design of the valve section 27 provides an unobstructed vertical passage through the pipe for full flow conditions and passage of any wireline tools that the operator may desire to run before, during or after the drill stem test.

Figure 3B:
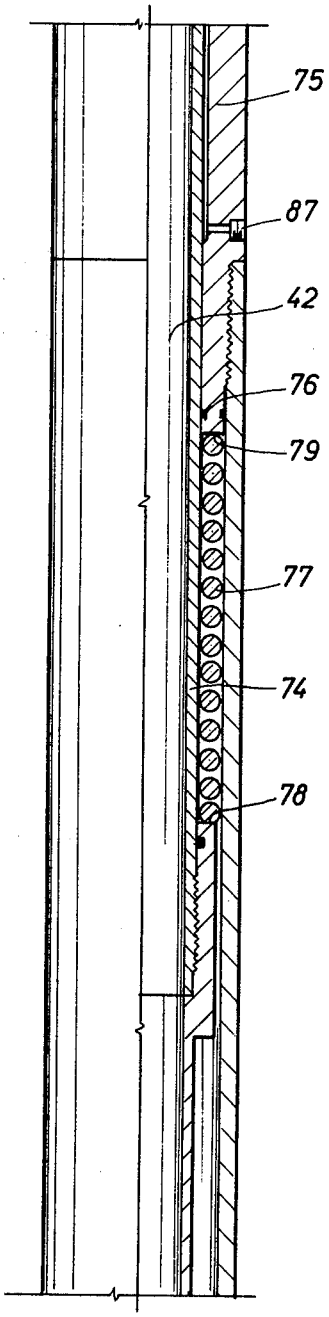
Figure 3C:
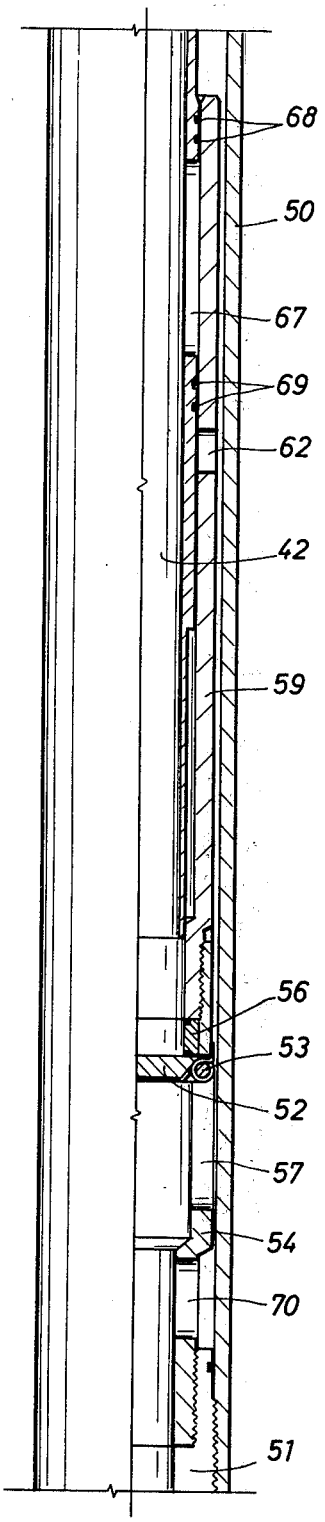

In the event the pipe string 12 should break in two below the subsea control valve 14, that portion of the pipe string leading to the formation will be automatically shut-in and closed, as follows. The unsupported piece of broken pipe will fall downwardly in the well, causing the slip joint section 25 to fully contract or close. When this occurs, the lower end surface 93 of the mandrel 28 engages the upper end face 94 of the sleeve piston 82 and forces it downwardly relative to the housing 50. As the depending sleeve portion 82 is forced into the pump chamber 86, it displaces a volume of the oil within the chamber and the increased pressure acts against the lower surface 94 of the piston section 80 on the actuator mandrel 74 to cause the mandrel to shift upwardly against the bias force of the power spring 77. As the actuator mandrel 74 shifts upwardly, the stinger tube 66 is withdrawn through the valve seat ring 56, enabling the flapper valve element 52 to close and prevent any upward flow of well fluids through the bore 42 through the tool. Subsequent to the closing of the valve element 52 as shown in FIG. 3C, the actuator mandrel 65 continues to move upwardly somewhat, and to the uppermost position where the seal rings 69 thereon are above the bypass and equalizing ports 62. Thus, both the valve element 52 and the ports 67, 62 are closed off to prevent upward flow of well fluids through the pipe string 12.

To reopen the valve element 52, tension is applied to cause the mandrel 28 to move upwardly within the housing 29 until the slip joint is completely open. As the lower end face 93 of the mandrel 28 moves upwardly, the coil spring 77 expands to cause downward movement of the actuator mandrel 74, which in turn pumps the sleeve piston 82 upwardly relative to the housing 50. The lower portions of the equalizing ports 67 come into registry with the sleeve ports 62 to equalize pressures across the valve element 52 as previously described, after which the valve element is moved to the open position as the stinger tube 66 is advanced through the seat ring 56.

It now will be recognized that a new and improved slip joint-safety valve apparatus has been disclosed which incorporates a valve element that when open provides a full opening bore for the passage of wireline tools, instruments or the like. Since certain changes or modifications may be made in the disclosed embodiment without departing from the inventive concepts involved, it is the aim of the appended claims to cover all such changes and modifications falling within the true spirit and scope of the present invention.

I claim:

1. Safety valve apparatus adapted for closing a well pipe against upward flow of fluids therethrough, comprising: tubular telescoping members defining a flow passage and movable between extended and contracted relative positions; full-opening valve means for opening and closing said flow passage, said valve means including a valve seat surrounding said flow passage and a valve element adapted to close upwardly against said valve seat; and actuator means including oppositely moving parts for opening said valve means in response to extension of said members and for closing said valve means in response to contraction of said members.

2. The apparatus of claim 1 wherein at least one of said parts is sealingly slidable with respect to one of said members to define an enclosed chamber containing hydraulic fluid, movement of the other of said parts in one longitudinal direction functioning to displace fluid in said chamber and cause movement of said one part in the opposite longitudinal direction.

3. The apparatus of claim 2 wherein said one part is operatively coupled to said valve means for actuating the same in response to such longitudinal movement, and said other part is arranged to be moved by the other of said members in response to contraction of said members.

4. The apparatus of claim 1 wherein said oppositely movable parts are sealingly slidable with respect to each other and one of said members and together with said one member define an enclosed chamber containing hydraulic fluid, longitudinal movement in one direction of one of said parts with respect to said one member displacing said hydraulic fluid and causing movement of the other of said parts with respect to said one member in the opposite longitudinal direction.

5. The apparatus of claim 4 wherein said one part includes a portion movable into and out of said chamber to effect displacement of said hydraulic fluid.

6. The apparatus of claim 1 wherein said valve means includes a flapper valve element movable between a closed position transverse to said flow passage and an open position to the side of said flow passage.

7. The apparatus of claim 1 further including means responsive to longitudinal movement of said actuator means for equalizing the pressures of fluids above and below said valve means prior to opening of said valve means.

8. The apparatus of claim 1 further including piston and cylinder means on said members for balancing out and cancelling the net effect on said members of changes in the pressure of fluids in said passage through said members.

9. The apparatus of claim 8 further including coengaged spline means on said members for preventing relative rotation thereof.

10. Safety valve apparatus for use in a well, comprising: an upper inner member telescopically disposed within a lower outer member and movable with respect thereto between extended and contracted relative positions, said members defining a flow passage extending longitudinally therethrough; full-opening valve means mounted on said outer member for opening and closing said flow passage; hydraulically operated first valve actuator means movable upwardly in said outer member for enabling closure of said valve means and downwardly in said outer member for causing opening of said valve means; chamber means containing hydraulic fluid cooperable with said first actuator means for moving said first actuator means in response to displacement of hydraulic fluid within said chamber means; and force responsive second valve actuator means movable downwardly in said outer member for displacing hydraulic fluid in said chamber means and causing upward movement of said first valve actuator means in response to telescoping relative movement of said members to said contracted position.

11. The apparatus of claim 10 further including spring means reacting between said first valve actuator means and said outer member for urging said first valve actuator means downwardly during upward movement of said second valve actuator means.

12. The apparatus of claim 10 wherein said chamber means is defined in part by said first valve actuator means, said second valve actuator means being sealingly slidable with respect to said first valve actuator means and said outer member.

13. The apparatus of claim 12 wherein said second valve actuator means includes upwardly facing surface means adapted to be engaged by downwardly facing surface means on said inner member to effect downward movement of said second valve actuator means in response to said telescoping relative movement.

14. The apparatus of claim 10 wherein said valve means includes a flapper valve element movable between a closed position transverse to said flow passage and an open position to the side thereof.

15. The apparatus of claim 10 further including equalizing valve means for equalizing the pressures of fluids in said flow passage above and below said valve means prior to the opening thereof by said first valve actuator means.

16. The apparatus of claim 10 further including piston means on said inner member movable in cylinder means on said outer member, the upper face of said piston means being subject to the pressure of fluids in said flow passage and the lower face of said piston means being subject to the pressure of fluids externally of said outer member, said piston and cylinder means being sized and arranged to balance out and cancel the net force on said members due to changes in the pressure of fluids in said flow passage.

17. The apparatus of claim 16 further including coengaged spline means on said members for preventing relative rotation thereof.

* * * * *